US008171605B2

(12) United States Patent
Schultz

(10) Patent No.: US 8,171,605 B2
(45) Date of Patent: May 8, 2012

(54) BELT BUCKLE

(76) Inventor: Bryan Schultz, Kenosha, WI (US)

( * ) Notice: Subject to any disclaimer, the term of this patent is extended or adjusted under 35 U.S.C. 154(b) by 601 days.

(21) Appl. No.: 12/338,208

(22) Filed: Dec. 18, 2008

(65) Prior Publication Data

US 2009/0151131 A1 Jun. 18, 2009

Related U.S. Application Data

(60) Provisional application No. 61/014,558, filed on Dec. 18, 2007.

(51) Int. Cl.
*A44B 11/00* (2006.01)

(52) U.S. Cl. ..... 24/163 R; 24/302; 24/662; 24/303

(58) Field of Classification Search ..... 24/289, 24/302, 639, 640, 652, 653, 662, 649; 84/327
See application file for complete search history.

(56) References Cited

U.S. PATENT DOCUMENTS

| | | | | |
|---|---|---|---|---|
| 2,833,015 | A | 5/1958 | Kreisler | |
| 4,642,855 | A | 2/1987 | Densmore | |
| 4,901,900 | A * | 2/1990 | Goto | 224/257 |
| 5,673,463 | A | 10/1997 | Chih-wen | |
| 6,032,339 | A * | 3/2000 | D'Addario | 24/649 |
| 6,065,367 | A | 5/2000 | Schroth | |
| 6,324,733 | B1 | 12/2001 | Brown | |
| 6,687,963 | B1 | 2/2004 | Chang | |
| 7,045,694 | B2 * | 5/2006 | Yasunori | 84/329 |
| 7,159,284 | B2 | 1/2007 | Gastaldi | |
| 7,888,572 | B2 * | 2/2011 | Rosenberg et al. | 84/327 |
| 2007/0107169 | A1 | 5/2007 | Kung | |

* cited by examiner

*Primary Examiner* — Robert J Sandy
*Assistant Examiner* — Michael Lee
(74) *Attorney, Agent, or Firm* — Whyte Hirschboeck Dudek SC

(57) ABSTRACT

A buckle for securing strap ends to each other has an anchor peg, with a recess, attached to one strap end. Another strap end has a clamping head that has a recess adapted to allow insertion and removal of the anchor peg. A moveable locking mechanism in the clamping head can be moved from an open position, that allows insertion or removal of the anchor peg, to a closed position that prevents removal of an anchor peg inserted into the clamping head.

6 Claims, 5 Drawing Sheets

BELT BUCKLE

CROSS-REFERENCE TO RELATED APPLICATION

This application claims the benefit of U.S. provisional patent application No. 61/014,558 entitled "BELT BUCKLE" filed on Dec. 18, 2007, the entirety of which is hereby incorporated by reference herein.

FIELD OF THE INVENTION

This invention relates generally to the field of clasping mechanisms, and more specifically, to an apparatus and method for attaching two straps, or two ends of the same strap, to each other.

BACKGROUND OF THE INVENTION

Means for securing ends of straps together are well-known. Such means include, for example, buckles, clasps and the like. Although many of the known buckles function sufficiently, the industry is always looking for designs that are simple to use and aesthetically pleasing. One objective of this invention is to provide such a buckle.

SUMMARY OF THE INVENTION

In one embodiment, the invention is an apparatus for buckling straps. The apparatus comprises an anchor peg attached to a first strap. The anchor peg has a first end proximate to the strap and a second end distal from the strap. Also, the anchor peg has at least one recess located between the proximate and distal ends. Additionally, a clamping head is attached either to the first strap or to a second strap. The clamping head has an opening that is adapted to receive insertion of the distal end of the anchor peg into the clamping head. Also, a locking element is operationally connected to the clamping head, with the locking element being selectively moveable from a first position to a second position. When the locking element is in the first position, the anchor peg can freely be inserted and removed from the opening in the clamping head. Conversely, when the locking element is in the second position the locking element engages the recess of an anchor peg inserted into the opening of the clamping head to prevent removal of the distal end of the anchor peg from the opening in the clamping head.

BRIEF DESCRIPTION OF THE DRAWINGS

Preferred embodiments of the invention are described below with reference to the following accompanying drawings, which are for illustrative purposes only. Throughout the following views, reference numerals will be used in the drawings, and the same reference numerals will be used throughout the several views and in the description to indicate same or like parts or steps.

DETAILED DESCRIPTION OF THE INVENTION

In the following detailed description, references made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that mechanical or shape changes may be made without departing from the spirit and scope of the present invention.

Figure 1:
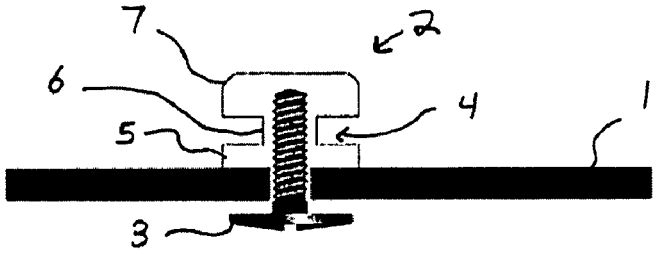
FIG. 1 shows a side view of an anchor peg mounted on a strap.

As shown in FIG. 1, an anchor peg 2 is attached to a strap 1. Strap 1 can be any suitable elongated piece, such as a belt. Although this invention is useable for attaching two straps together, or attaching one end of the strap to the other end of the strap, and the strap 1 need not be substantially flat as shown, for purposes of convenience, the invention will be described in the embodiment in which strap 1 is a belt that will be worn by a person with their clothing.

Anchor peg 2 is attached to strap 1 by any convenient means, such as screw 3 passing through a hole in strap 1 as shown. Anchor peg 2 has a proximate end 5 which is adjacent to or in contact with strap 1 and a distal end 7 which extends away from strap 1. A recess 4 is located on anchor peg 2 between the proximate end 5 and distal end 7. In the preferred embodiment shown, recess 4 is an annual groove such that anchor peg 2 has an approximately spool shape with an axle 6 between proximate end 5 and distal end 7. However, recess 4 can be of any suitable shape and configuration, such as slots, holes, notches, and the like.

In the preferred embodiment, FIGS. 2A-2F show front, back, and side views, respectively, of a sliding clamping head 8. Sliding clamping head 8 comprises a front component 9 and a back component 10. Back component 10 is attached to strap 1 through attachment means 13. Attachment means 13 can be any suitable mechanism such as a tooth clamp. Front component 9 slides back and forth in relation to back component 10. An opening 12 is provided in back component 10 for insertion of an anchor peg 2. A locking mechanism 11 is attached to front component 9. As shown, when front component 9 is in the open position (FIG. 2C), locking mechanism 11 is clear of opening 12 thereby allowing anchor peg 2 to be freely inserted and removed from clamping head 8. For convenience, back component 10 may be disassembled by removing retaining screw 14.

Views 2B, 2D and 2F show front, back, and side views of the sliding clamping head 8 when in the closed position.

Figure 2A:
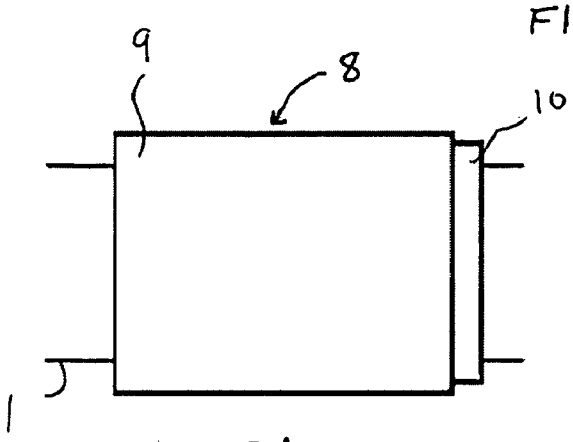
FIGS. 2A, 2C and 2E show front, back and side views of a buckle of the invention in open positions, respectively.
Figure 2B:
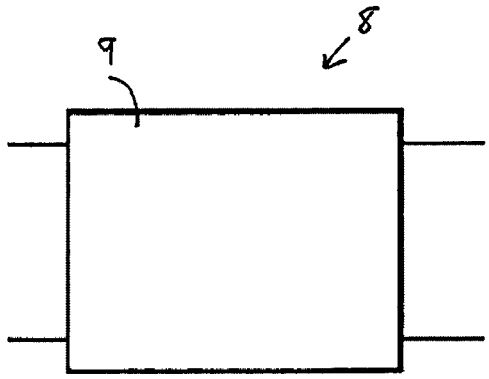
FIGS. 2B, 2D and 2F show front, back and side views of a buckle of the invention in closed positions, respectively.
Figure 2C:
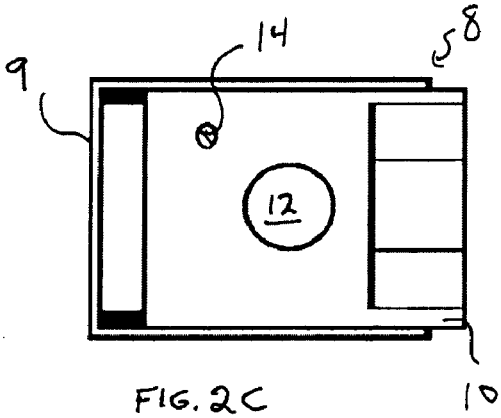
Figure 2D:
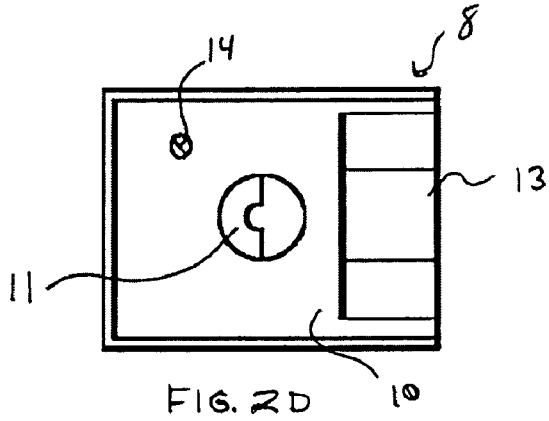
Figure 2E:
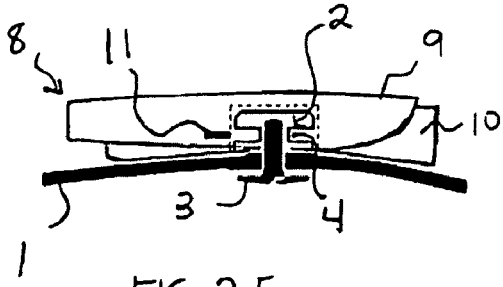
Figure 2F:
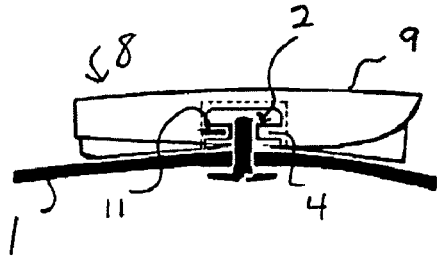

When sliding clamping head 8 is in the closed position, locking mechanism 11 extends into opening 12. The extension of locking mechanism 11 into opening 12 prevents the insertion or removal of an anchor peg 2. Particularly as seen in FIG. 2F, when an anchor peg 2 is inserted into opening 12 and the front component 9 is moved into a closed position, locking mechanism 11 moves into locking engagement with recess 4 in anchor peg 2. This locking engagement prevents removal of anchor peg 2 from opening 12 thereby securing sliding clamping head 8 to the end of the strap 1 where anchor peg 2 is located. As described in other embodiments, a biasing means, such as a spring or a magnet, or a combination of both may be provided to force locking mechanism 11 against an edge of recess 4 thereby providing a more secure locking engagement.

Figure 3A:
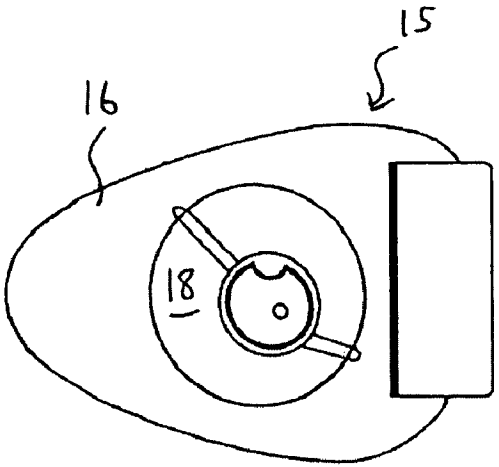
FIGS. 3A and 3B show front and back views of a second embodiment of the buckle of this invention in open positions, respectively.
Figure 3B:
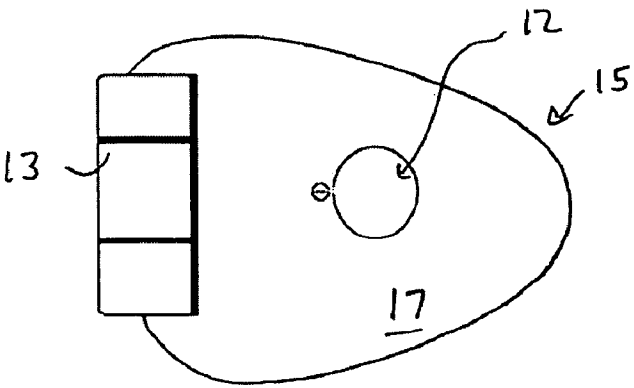
Figure 3C:
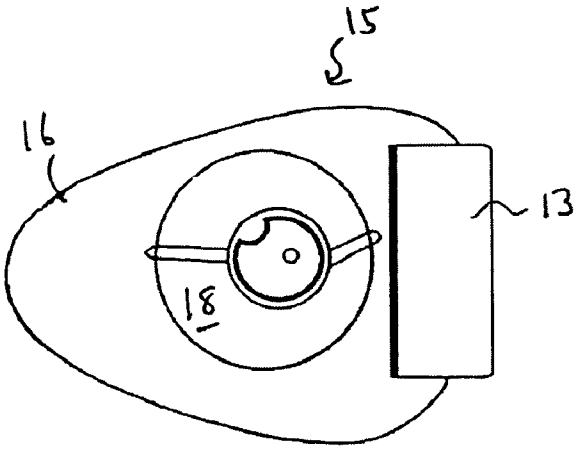
FIGS. 3C and 3D show front and back views of a second embodiment of the buckle of this invention in closed positions, respectively.
Figure 3D:
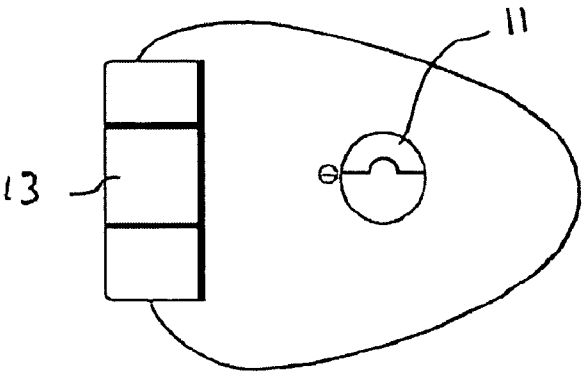

In another preferred embodiment, as shown in FIGS. 3A-3D, the locking mechanism rotates into position instead of sliding linearly into position. As shown in FIGS. 3A and 3B, rotational lock clamping head 15 comprises a front component and back component 16 and 17, respectively. A rotatable dial 18 is mounted on front component 16. Dial 18 is connected with locking mechanism 11 (FIG. 3D). Back component 17 has an opening 12 as described previously. When the locking mechanism is in the locking position, opening 12 is unobstructed allowing free insertion and removal of an anchor peg 2. As shown in views C and D, when dial 18 is moved to the closed position, locking mechanism 11 moves to partially obstruct opening 12. As described in the previous embodiment, this obstruction allows locking mechanism 11 to enter into locking engagement with recess 4 of anchor peg 2.

Figure 4A:
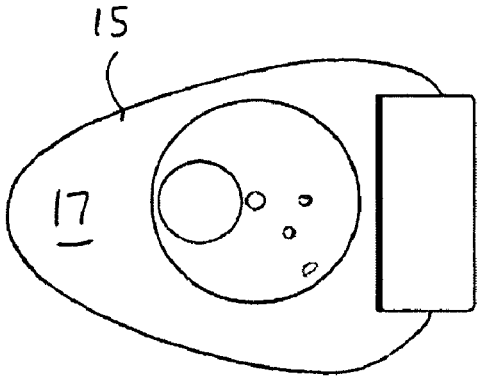
FIG. 4A shows a front view of the second embodiment of this invention with the sliding mechanism removed.
Figure 4B:
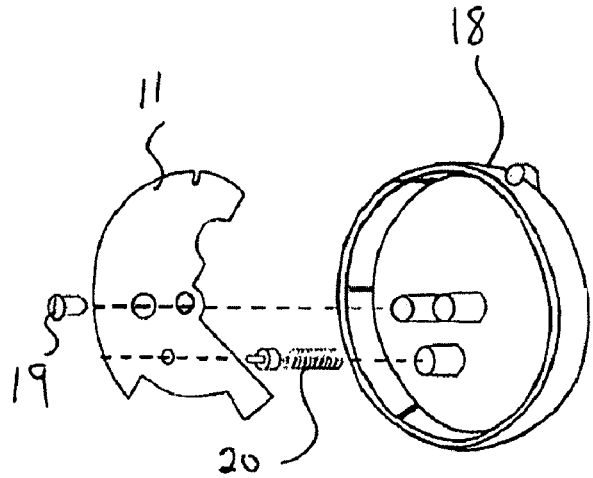
FIG. 4B shows an exploded view of the slide mechanism of the second embodiment of this invention.
Figure 5A:
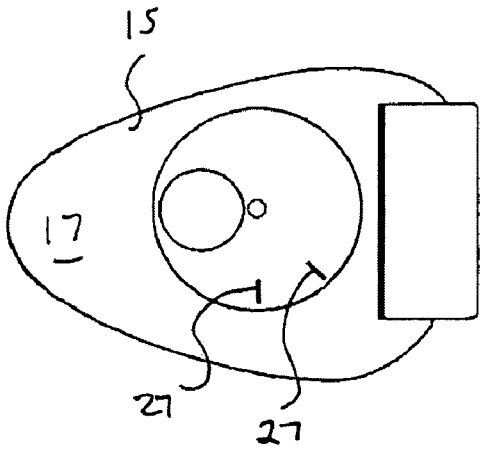
FIG. 5A shows a front view of the third embodiment of this invention with the sliding mechanism removed.
Figure 5B:
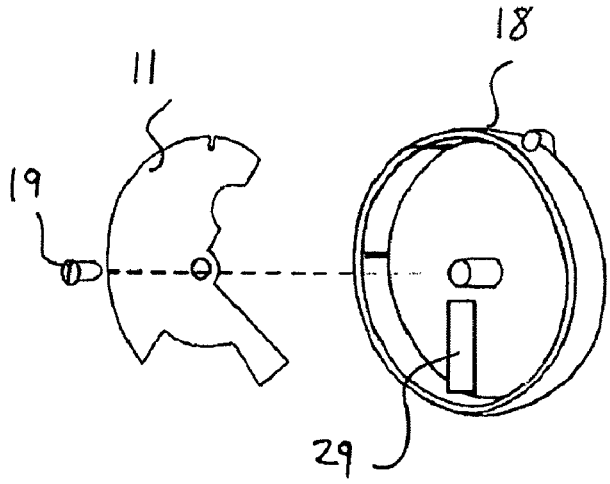
FIG. 5B shows an exploded view of the slide mechanism of the third embodiment of this invention.

FIG. 4A shows a front view of the rotating lock clamping head 15 with dial 18 and the locking mechanism 11 removed. FIG. 4B shows an exploded view of dial 18 and locking mechanism 11. As shown, locking mechanism 11 is secured to dial 18 by any simple means such as the securing screw 19 shown. Additional pegs or notches may be provided on dial 18 and/or locking mechanism 11 to further secure locking mechanism 11 in the desired orientation respective to dial 18. Also, a biasing means 20, such as a spring, may be installed between dial 18 and locking mechanism 11. The biasing means 20 forces the locking mechanism 11 into contact with an edge of recess 4 of anchor peg 2. In an alternate embodiment of the invention, as shown in FIGS. 5A and 5B, the biasing means 20 can be one or more magnets 27, wherein a ferrous material, for example steel, is secured to the dial 18 for securing one of the magnets 27.

Figure 6A:
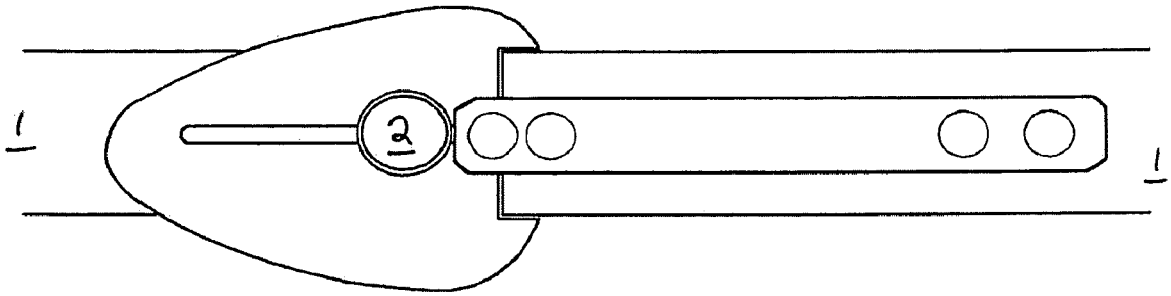
FIGS. 6A and 6B show top and side views, respectively, of a fourth embodiment of the buckle of this invention in the closed position.
Figure 6B:
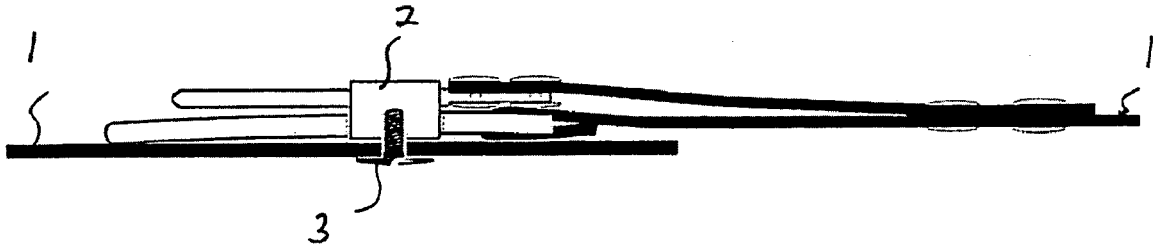
Figure 7A:
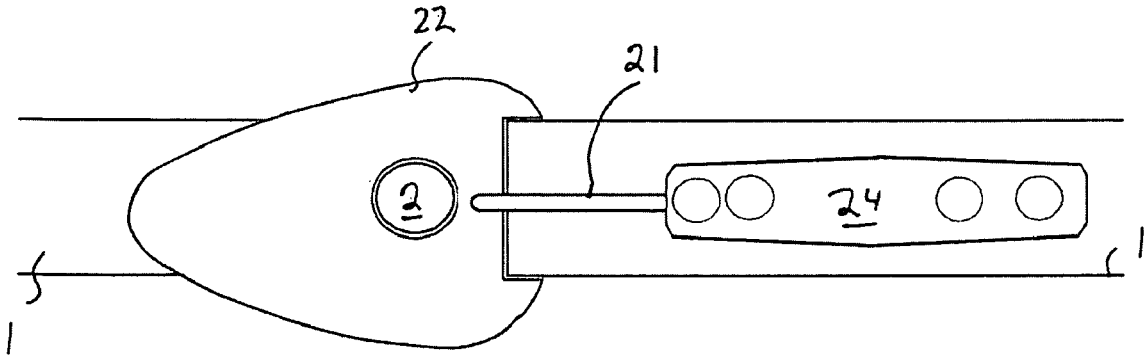
FIGS. 7A and 7B show front and side views, respectively, of the fourth embodiment of this invention in open position.
Figure 7B:
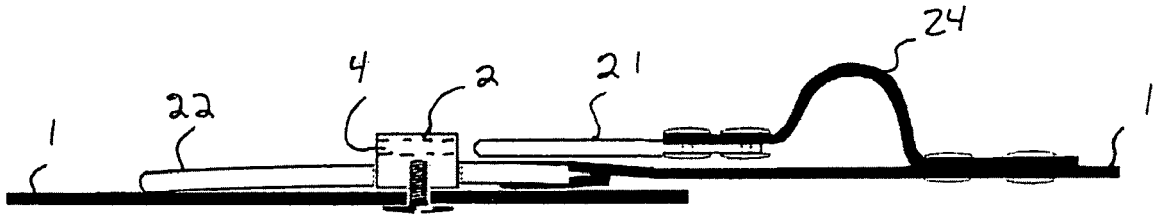
Figure 8:
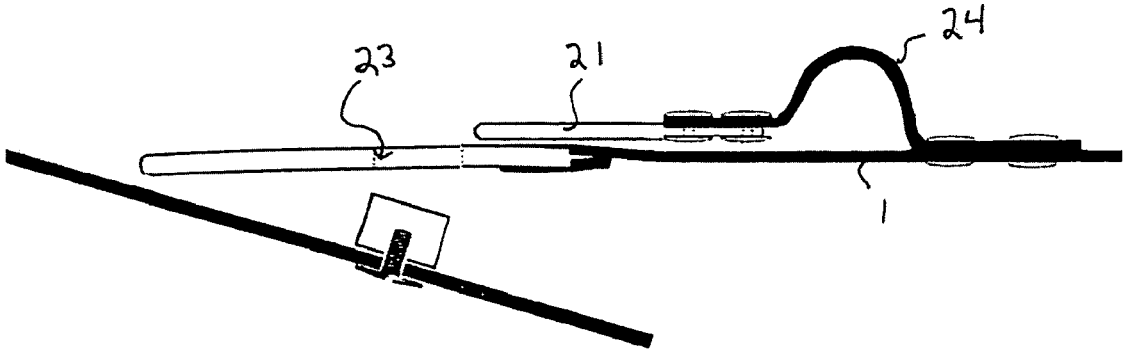
FIG. 8 shows a side view of the fourth embodiment of this invention with the anchor pulled away from the clamping head.

A fourth preferred embodiment of this invention is shown in FIGS. 6-8. Referring to FIGS. 6A and 6B, an anchor peg 2 is affixed to a strap 1 by suitable means such as screw 3. As shown in FIGS. 7A and 7B, recess 4 is a hole bored through anchor peg 2 and allows for insertion of locking element 21. As shown in FIG. 8, anchor peg 2 is adapted to fit through an opening 23 of clamping head 22. When locking mechanism 21 is inserted through the hole forming recess 4 in anchor peg 2, anchor peg 2 can no longer pass through opening 23 in clamping head 22. A flexible connector 24 connects locking mechanism 21 to strap 1 on the same end of the strap as clamping head 22. Flexible connector 24 may be any suitable device, but as shown here is a smaller strap of leather. In the relaxed position, flexible connector 24 is fully extended as shown in FIG. 6.

Referring now to FIG. 7, flexible connector 24 is bent, thereby withdrawing locking mechanism 21 from recess 4 in anchor peg 2. Disengaging locking mechanism 21 from anchor peg 2 allows anchor peg 2 to be disengaged from clamping head 22. Such disengagement is further illustrated in FIG. 8.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An apparatus for buckling straps, comprising:

an anchor peg attached to a first strap, the anchor peg having a first end proximate to the strap and a second end distal from the strap, wherein the anchor peg has at least one recess located between the proximate and distal ends;

a clamping head attached either to the first strap or to a second strap, the clamping head having an outer portion and an inner portion, one or more magnets secured to a surface of said inner portion, and an opening extending therethrough that is adapted to receive insertion of the distal end of the anchor peg into or through the opening through the clamping head; and a rotatable cover removably attached to the outer portion of the clamping head, the rotatable cover being selectively moveable and rotatable from a first position to a second position, the rotatable cover comprising an outer portion and an inner portion, a locking element removable secured to said inner portion of the rotatable cover and a ferrous material component secured to a surface of said inner portion of the rotatable cover;

wherein, when the rotatable cover is in the first position, the anchor peg can freely be inserted and removed from the opening in the clamping head and when the rotatable cover is in the second position, at least one of the magnets is biased against and releasably secured to the ferrous material component and the locking element is biased against and engages the recess of said anchor peg inserted into the opening of the clamping head to prevent removal of the distal end of the anchor peg from the opening through the clamping head.

2. The apparatus of claim 1 wherein the recess is an annular groove along a circumference of the anchor peg.

3. The apparatus of claim 1, wherein the locking element comprises a notch adapted to fit in the annular groove of an anchor peg.

4. The method of claim 1, wherein the one or more magnets comprises first and second spaced apart magnets secured to the surface of the inner portion of the clamping head, and the ferrous material component on the inner portion of the cover is positioned between said magnets, and when the rotatable cover is in the first position, the first magnet is biased against and releasably secured to the ferrous material component and the locking mechanism does not obstruct the opening in the clamping head, and when the rotatable cover is in the second position, the second magnet is biased against and releasably secured to the ferrous material component and the locking element partially obscures the opening in the clamping head.

5. A method for buckling a strap, the method comprising:

attaching an anchor peg attached to a first end of the strap, the anchor peg having a first end proximate to the strap and a second end distal from the strap, wherein the anchor peg has at least one recess located between the proximate and distal ends;

attaching a clamping head to a second end of the strap, the clamping head having an outer portion and an inner portion, one or more magnets secured to a surface of said inner portion, and an opening extending therethrough that adapted to receive insertion of the distal end of the anchor peg into or through the opening through the clamping head and having a rotatable cover removably attached to the outer portion of the clamping head, the rotatable cover selectively moveable and rotatable from a first position to a second position, the rotatable cover comprising an outer portion and an inner portion, a locking element removable secured to said inner portion of the rotatable cover and a ferrous material component secured to a surface of said inner portion of the rotatable cover;

moving the rotatable cover into a first position wherein the anchor peg can be inserted into the opening through the clamping head;

inserting the anchor peg into the opening through the clamping head; and moving the rotatable cover into a second position such that at least one of the magnets is biased against and releasably secured to the ferrous material component and the locking element is biased against and engages the recess of the anchor peg to prevent removal of the distal end of the anchor peg from the opening through the clamping head.

6. The method of claim 5, wherein the one or more magnets comprises first and second spaced apart magnets secured to the surface of the inner portion of the clamping head, and the ferrous material component on the inner portion of the cover is positioned between said magnets, and moving the rotatable cover into the first position biases the first magnet against the ferrous material component and moving the rotatable cover into the second position biases the second magnet against the ferrous material component to releasably secure the locking element engaged with the recess of the anchor peg.

* * * * *